United States Patent [19]

Norden

[11] 4,386,329

[45] May 31, 1983

[54] STORED ENERGY TRIP UNIT

[75] Inventor: Alexander R. Norden, New York, N.Y.

[73] Assignee: GTE Laboratories Incorporated, Waltham, Mass.

[21] Appl. No.: 278,776

[22] Filed: Jun. 29, 1981

[51] Int. Cl.[3] ..... H01H 73/48; H01H 75/12

[52] U.S. Cl. ..... 335/35; 335/21; 335/42

[58] Field of Search ..... 335/35, 42, 21, 22, 335/176, 44

[56] References Cited

U.S. PATENT DOCUMENTS

| | | | |
|---|---|---|---|
| 3,264,428 | 8/1966 | Hollyday | 335/35 |
| 3,487,343 | 12/1969 | Myers et al. | 335/35 |
| 4,090,156 | 5/1978 | Gryctko | 335/35 |

FOREIGN PATENT DOCUMENTS

| | | | |
|---|---|---|---|
| 28601 | 12/1932 | Netherlands | 335/35 |

*Primary Examiner*—Harold Broome
*Attorney, Agent, or Firm*—Fred Fisher

[57] ABSTRACT

A movable contact is adapted to engage with and disengage from a fixed contact within a circuit breaker housing. A contact arm, coupled to the movable contact, is caused to trip when appropriate means are actuated. The invention resides in apparatus for actuating such means including a ferromagnetic material armature latch partially rotatable about a housing axis. The latch has a first retaining means and a first coupling surface. A latch member, partially rotatable about a housing axis, has a second retaining means and a second coupling surface adapted to couple with the first coupling surface. Further, the latch member is adapted to recouple the second coupling surface subsequent to it becoming uncoupled from the first coupling surface. A spring couples the two retaining means. An electrical circuit, including the contacts, is responsive to an overload current through the circuit breaker for causing the armature latch to partially rotate, uncoupling the two coupling surfaces, whereupon the spring causes the latch member to rotate with an impetus, actuating the coupled means, thereby tripping the contact arm and opening the contacts.

8 Claims, 5 Drawing Figures

STORED ENERGY TRIP UNIT

CROSS REFERENCE TO RELATED APPLICATION

This invention is related to subject matter disclosed in co-pending U.S. patent application Ser. No. 277,888, entitled "Circuit Breaker", filed Jan. 23, 1981.

BACKGROUND AND SUMMARY OF THE INVENTION

This invention relates to circuit breakers, and, in particular, to a stored energy trip unit for use in a circuit breaker. Accordingly, it is a general object of this invention to provide new and improved devices of such character.

One object of this invention is to provide a new and improved stored energy trip unit, for use in a circuit breaker, which is independent of case stability.

Another object of this invention is to provide a new and improved stored energy circuit breaker trip unit suitable in a variety of housing configurations.

Still another object of this invention is to provide a new and improved stored energy circuit breaker trip unit which is insensitive to inaccuracies in a molded housing, such as post-molding shrinkage, warpage of the housing, and wear of operating parts.

Still yet another object of this invention is to provide a new and improved circuit breaker which is capable of being calibrated prior to assembly in a circuit breaker housing, thereby affording manufacturing economies through the reduction of labor in assembly and disassembly of uncalibrated circuit breakers.

One embodiment of the invention relates to a circuit breaker which includes a movable contact which is adapted to engage with and disengage from a fixed contact within a circuit breaker housing. A contact arm is coupled to the movable contact. Appropriate means causes the contact arm to trip when such means is actuated. The improvement is directed to apparatus for actuating such means including a ferrous material armature latch which is partially rotatable about a housing axis. The armature latch has a first retaining means and a first coupling surface. A striker latch member, partially rotatable about a housing axis, has a second retaining means, a second coupling surface adapted to couple with the first coupling surface, and means for recoupling the second coupling surface subsequent to the second coupling surface becoming uncoupled from the first coupling surface. A spring is coupled between the two retaining means. An electrical circuit, including the contacts, is responsive to an overload current through the circuit breaker for causing the armature latch to partially rotate, uncoupling the two coupling surfaces, whereupon the spring causes the latch member to rotate, providing an impact momentum for actuating the means coupled to the contact arm, thereby tripping the contact arm, and opening the contact. In accordance with certain features of the invention, the armature latch axis and the latch member axis are non-coincident. The two coupling surfaces can have relatively low coefficients of friction.

In accordance with another embodiment of the invention, a circuit breaker includes a movable contact which is adapted to engage with and disengage from a fixed contact within a housing, a contact arm coupled to the movable contact, means when actuated for causing the contact arm to trip, and apparatus for actuating the means. The invention is directed to an improvement wherein the apparatus includes an electrical circuit having a bimetal strip having one end affixed to a load terminal and having an opposite end free to bend when thermally excited. A flexible conductive braid couples such opposite end to the contact arm. The load terminal is fixed with respect to the housing. A ferrous material armature latch is partially rotatable about a point with respect to the housing. The latch has a first end adapted to engage with the opposite end of the bimetal strip, a second end provided with a first retaining means, and an intermediate coupling portion. A latch member, partially rotatable about a point with respect to the housing, has a portion thereof provided with a second retaining means. The latch member has a coupler adapted to couple with respect to the coupling portion, and has an arm for recoupling the coupler subsequent to the coupler becoming uncoupled from the coupling portion. A spring is coupled between the two retaining means. Thus, a small magnitude current overload through the electrical circuit causes the bimetal strip to be thermally excited and bend, moving and partially rotating the first end of the armature latch, thereby uncoupling the coupling portion from the coupler, whereupon the spring causes the latch member to be rotated, providing an impact momentum to actuate the means coupled to the contact arm, thereby tripping the contact arm, opening the contacts. A high magnitude current overload through the electrical circuit sets up a sufficiently strong magnetic field to thereby rapidly attract and partially rotate the first armature latch, thereby uncoupling the coupling portion from the coupler, whereupon the spring causes the latch member to be rotated, providing an impetus to actuate the means coupled to the contact arm, thereby tripping the contact arm, and opening the contacts. In accordance with certain features of the invention, the armature latch point and the latch member point are separate from each other. With certain features of the invention, the coupling portions have relatively low coefficients of friction. With other features of the invention, the ferrous member can be coupled to the bimetal strip.

In accordance with yet another embodiment of the invention, a trip unit for a circuit breaker includes three members. A first member is adapted to pivot about an axis of a carrier member. A second member is adapted to pivot about a separate, spaced-apart axis of the carrier member. A spring connects the first member to the second member so that latching portions thereof, distant from the axes, are latched together forming a triangular geometry. Rotation of the first member about the first axis in an unlatching direction causes the first member to unlatch from the second member. Rotation of the second member about the other axis in a latching direction causes the second member to latch with the first member.

In accordance with still yet another embodiment of this invention, a circuit breaker includes trip unit means, integrally amenable to calibration, and a circuit breaker mechanism located within a housing. The trip unit means is normally not in direct contact with the mechanism. The trip unit means stores energy therein, and, upon actuation of such means, effects tripping of the mechanism.

BRIEF DESCRIPTION OF THE DRAWINGS

Other objects, advantages, and features of this invention, together with its construction and mode of operation, will become more apparent from the following description, when read in conjunction with the accompanying drawings, in which.

DESCRIPTION OF A PREFERRED EMBODIMENT

Figure 1:
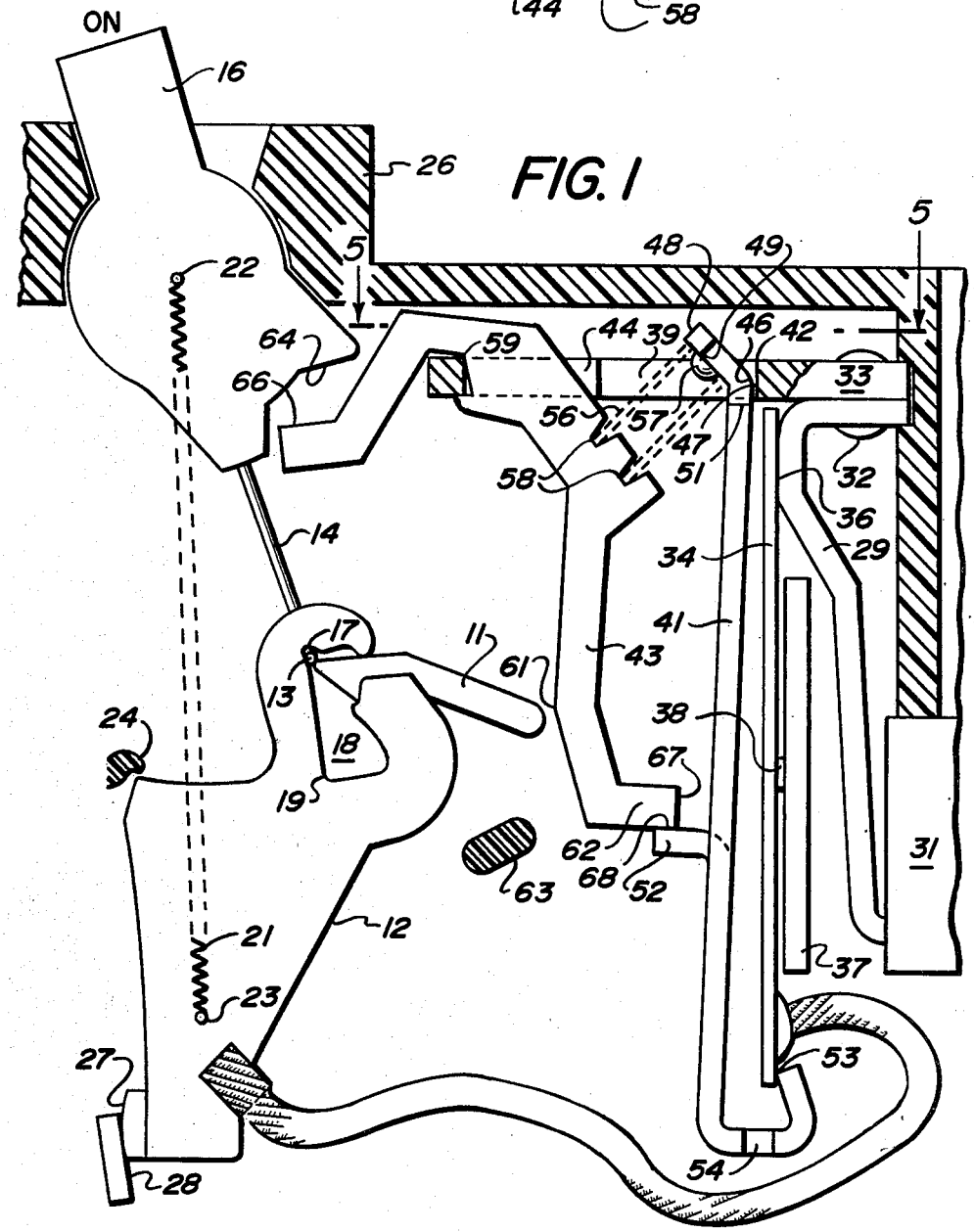
FIG. 1 is a plan view of a portion of a circuit breaker, with the cover removed, showing a preferred embodiment of the invention, with the circuit breaker in the "ON" condition.

The operative circuit breaker mechanism is described in the co-pending patent application referred to hereinabove, and reference is made to the description therewithin. Referring to FIG. 1, tripping occurs when a trip latch 11 is elastically deflected clockwise towards a contact arm 12 so that an extending hook 13 of a wire member 14, held by a handle 16, is released from a U-shaped recess 17 of a triangular pocket 18, thereby urging a corner 19 thereof toward the hook 13 by force of a spring 21 (coupled between a handle axis 22 and a point 23 on the contact arm 12). With the aid of an abutment 24 projecting from a housing 26, a movable contact 27 affixed to the contact arm 12 withdraws rapidly from a fixed contact 28 held by the housing 26.

A load terminal 29, preferably of copper alloy, is rigidly located by grooves and ridges (not shown) in the housing 26. One end of the load terminal 29 extends into a wire connector 31. The other end of the load terminal 29 is held by a rivet 32 to a carrier 33. A bimetal strip 34 is welded to the load terminal 29 at its end 36. The low expanding side of the bimetal strip 34 is oriented facing the load terminal 29.

Figure 5:
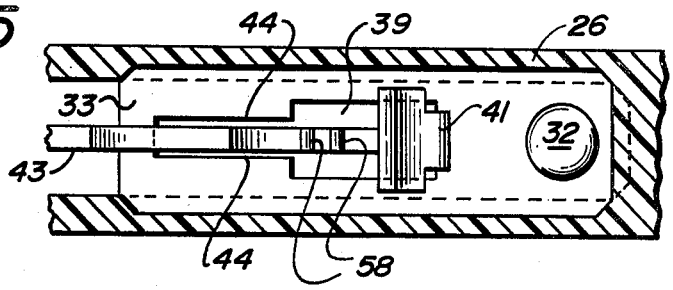
FIG. 5 is a top view of the circuit breaker depicted in FIG. 1.

A flat or U-shaped rectangular member 37 is welded at a point 38 to the bimetal strip 34. The member 37 is of a ferrous material, such as mild steel. The carrier 33 is, preferably, constructed of punching-grade, rigid, heat-resistant, reinforced plastic sheet stock. As shown in FIGS. 1 and 5, the carrier 33 is essentially rectangular in shape, with an elongated stepped slot 39 pierced along its center line. The carried 33 is held along its length in molded grooves in the case and cover of the housing 26.

An armature latch 41 is located in the carrier 33 in a stepped end of the slot 39 on the right side (FIG. 1) at a point 42. A striker latch 43 is supported in a narrow slot 44 on the left portion of the carrier 33.

The armature latch 41, also ferrous material such as steel, rests with a narrowed curved portion 46 against a surface 47 of the carrier 33. The elongated body of the armature latch 41 and its top portion 48 are wider than the slot 39 in the carrier 33. Thus, while the armature latch 41 may partially rotate about the surface 47, it is substantially prevented from moving vertically (as viewed in the drawing) because a corner 49 of the portion 48 absorbs downward thrust, and an edge 51 on the elongated body of the armature latch 41 limits upward movement.

An angled lance 52 extends from the armature latch 41, being struck out therefrom. A lower end of the armature latch 41 is bent to the right and upward (as viewed in FIG. 1–4) to engage at a position 53 with the bimetal strip 34. The bent horizontal section of the armature latch 41 is notched at a position 54 so as to weaken it thereat for easier bending and calibration.

The striker latch 43, made of flat stock and shaped as shown, is hooked on the left end of the carrier 33 (FIG. 1) and is prevented from side-to-side movement by the sides 44—44 of the carrier slot 39 (FIG. 5). Molded housing ribs (not shown) limit such movement at the lower end. A compression spring 56 is retained in position by a bump 57 on the armature latch 41 and notches 58—58 within the striker latch 43. The compression spring 56 exerts a force against the armature latch 41 and the striker latch 43, biasing the armature latch 41 for clockwise rotation about the surface 47 (as shown in FIG. 1) and the striker latch 43 for the clockwise rotation about an edge 59 on the carrier 33.

As depicted in FIG. 1, the operating ratios are such that when the compression spring 56 exerts a force F, the force available at a distant point 61 for deflecting the trip latch 11 is approximately one-half F (because the distance between the edge 59 and the compression spring 56 is approximately one-half the distance between the edge 59 and the distant point 61, as viewed in the drawings). Further, the force acting on the bimetal strip 34 at the point 53 is about one-twentieth F, because the distance from a pivoting point against the surface 47 and the point 53 is about twenty times that of the distance between such surface 47 and the bump 57.

The normal latched position is shown in FIG. 1. The compression spring 56 biases the armature latch 41 so that the point 53 thereon rests against the bimetal strip 34. A toe 62 of the striker latch 43 is engaged by the lance 52 of the armature latch 41, preventing the compression force of the spring 56 from rotating the striker latch 43. When the bimetal strip 34 is heated, its lower end moves toward the right (as viewed in the drawing), pushing on the point 53 on the armature latch 41, carrying it to the right. Alternatively, an overload of sufficient magnitude creates a magnetic field strong enough to attract the armature latch 41 to the bimetal strip 34 and to the magnetic pole piece member 37, also resulting in the armature latch 41 moving toward the right. At a certain point in the movement, the toe 62 of the striker latch 43 disengages from the lance 52 of the armature latch 41, becoming free to pivot about the edge 59. This triggering action releases the striker latch 43 which strikes the trip latch 11, disengaging the mechanism at the hook 13. The forward movement of the striker latch 43 is stopped past the mechanism tripping point by a molded ledge 63 of the housing 26 (FIG. 2).

Figure 2:
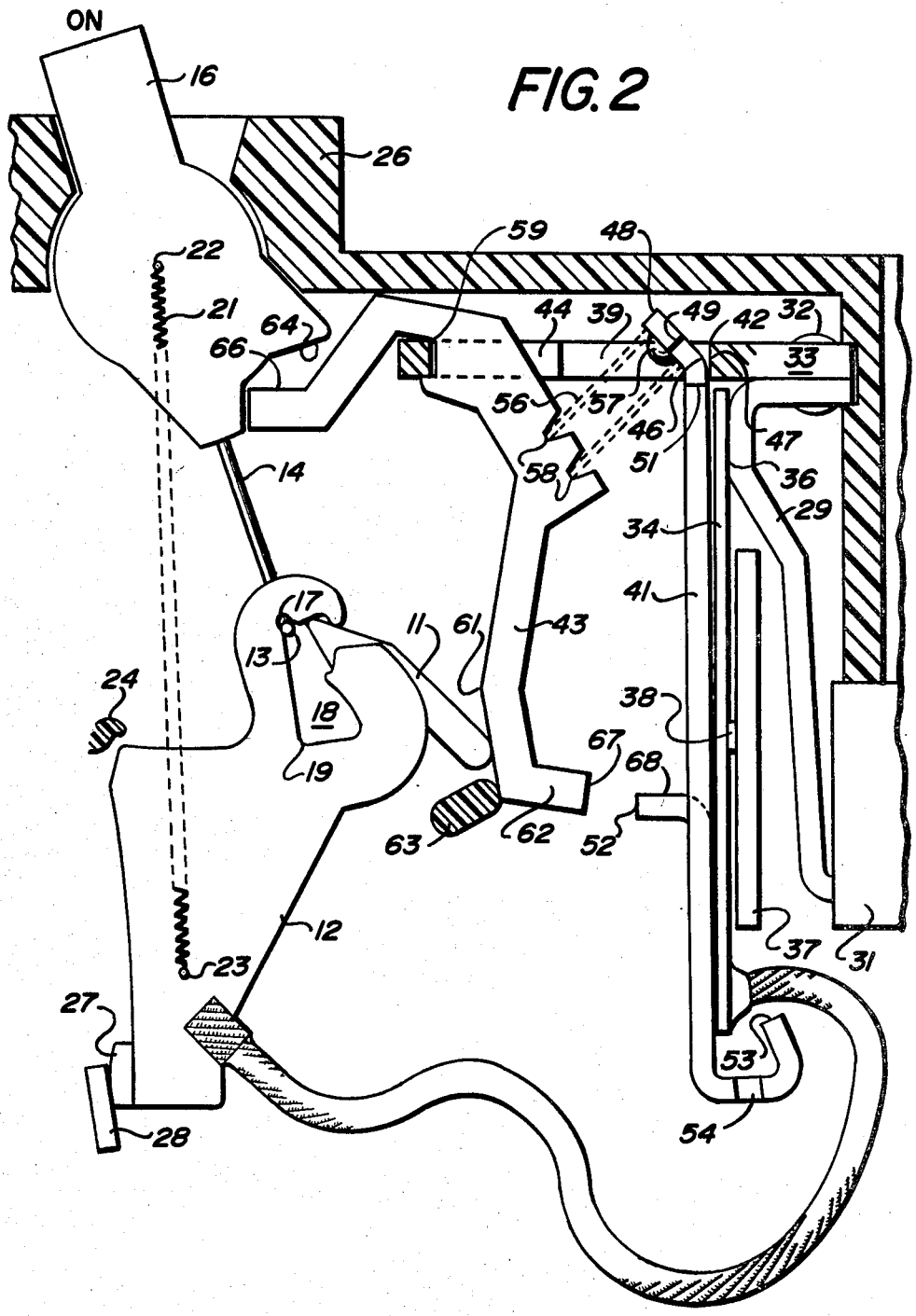
FIG. 2 is a plan view of the embodiment shown in FIG. 1, showing the circuit breaker in a condition during tripping.
Figure 3:
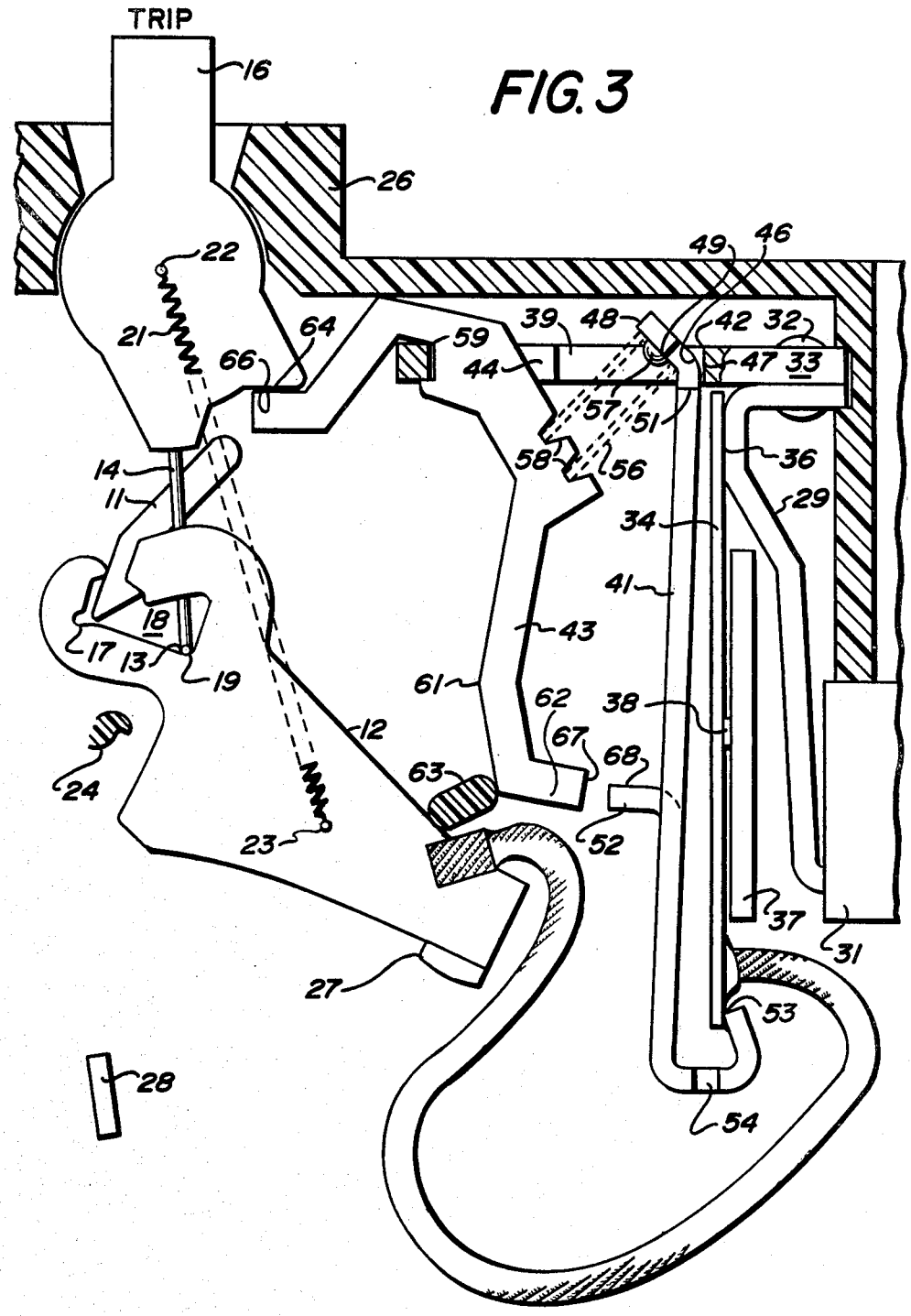
FIG. 3 is a plan view of the embodiment shown in FIG. 1 showing the circuit breaker in a tripped condition.

FIG. 2 indicates the position of the circuit breaker mechanism during tripping, wherein the striker latch 43 has just deflected the trip latch 11. The force applied to the trip latch 11 is proportional to the mass of the striker latch 43 and its deceleration upon hitting the trip latch 11, and an additional force continues to be applied by the residual compression of the spring 56. The force exerted by the residual compression of the spring 56 alone can be strong enough to cause deflection of the trip latch 11 even without impact due to momentum. The sequence immediately following is shown in FIG. 3 wherein the circuit breaker trips. The distance that the bimetal strip 34 deflects to disengage the toe 62 from the lance 52 is determined by bending the short leg of the armature latch 41 at the point 54 so that the point 53 moves to the left or to the right as desired, thus constituting calibration of the trip unit. The amount of engagement is determined by the geometry in relative positions of the carrier 33, the striker latch 43, the armature latch 41, and the bimetal strip 34, and is thus independent of the housing 26 or the breaker operating mechanism. The exact position of the trip latch 11 in relation to the striker latch 43 is not critical, nor is the distance through which the trip latch 11 has to be moved, as long as excess movement of the striker latch 43 is available.

Figure 4:
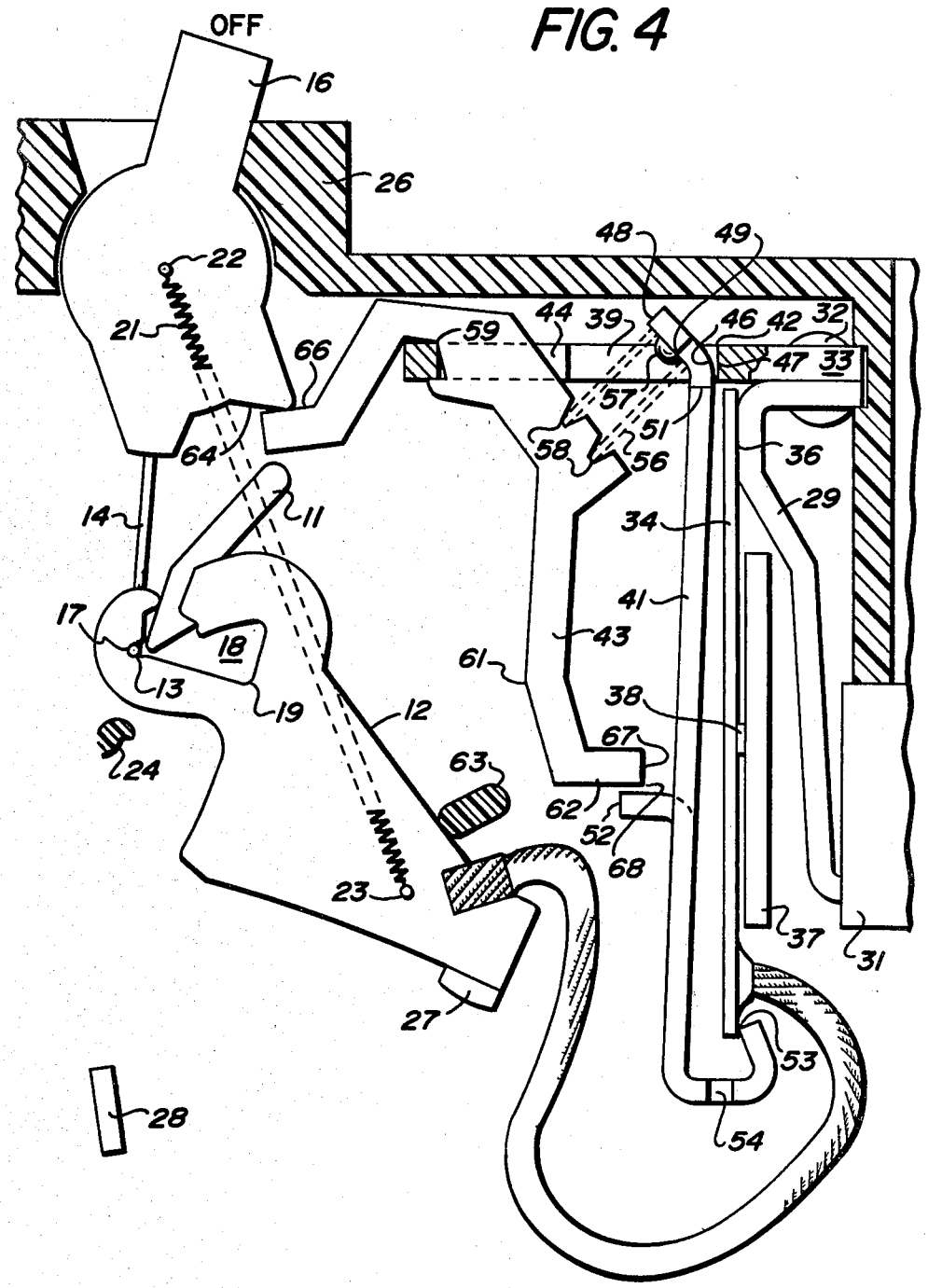
FIG. 4 is a plan view of the circuit breaker of FIG. 1 showing the circuit breaker being placed in the "OFF", or reset condition.

Referring to FIG. 3, upon tripping, the handle 16 stops in its midpoint indicating position. The mechanism is relatched, as indicated in FIG. 4, by moving the handle 16 manually clockwise to "OFF". The handle 16 has a projection 64 which engages the striker latch 43 at an edge 66 thereof, forcing the striker latch 43 to rotate counterclockwise about the edge 59 while the handle is turned clockwise. An edge 67 of the striker latch 43 comes into contact with an edge of the lance 52 of the armature latch 41, driving the armature latch 41 to the right against the bias of the compression spring 56. Continued rotation compresses the spring 56, storing energy therein. Because the striker latch 43 rotates about the edge 59, while the armature latch 41 rotates about the surface 47, the edge 67 slides upward past the edge of the lance 52, releasing the armature latch 41 and permitting it to snap back as biased by the compression spring 56 so that the point 53 rests against the bimetal strip 34 so that the lance 52 and the toe 62 overlap above a point 68. When the handle 16 is in its full "OFF" position, the toe 62 reaches the position shown in FIG. 4. Beginning of handle movement to "ON" permits the toe 62 of the striker latch 43 to come to rest against the lance 52 of the armature latch 41, in its latched position, ready to be triggered again should an overload condition exist when the contacts 27, 28 meet.

In a typical embodiment, the compression spring 56 can exert a force of ten ounces at the notches 58—58 and the bump 57, with a latch pressure of about four ounces at the point 68, and a bias force of about one-half ounce at the point 53. Assuming the lance 52 and the toe 62 to have polished surfaces, a total force of about one and one-quarter ounces is required to move the armature latch 41 to unlatch, permitting low magnetic trip values.

Other modifications will be apparent to those skilled in the art, without departing from the spirit and scope of the appended claims.

What is claimed is:

1. In a circuit breaker including
a housing;
a fixed contact held by said housing;
a contact movable within said housing, adapted to engage with and disengage from said fixed contact;
a contact arm coupled to said movable contact;
means coupled to said contact arm for causing said contact arm to trip when said means is actuated; and
apparatus for actuating said means, the improvement wherein said apparatus comprises
an armature latch of soft magnetic material partially rotatable about an axis with respect to said housing,
having a first retaining means, and
having a first coupling surface;
a striker latch member partially rotatable about an axis with respect to said housing,
having a second retaining means,
having a second coupling surface adapted to couple with said first coupling surface, and
having means for recoupling said second coupling surface subsequent to said second coupling surface becoming uncoupled from said first coupling surface;
a spring coupled between said first retaining means and said second retaining means; and
an electrical circuit, including said contacts, responsive to an overload current through said circuit breaker for causing said armature latch to partially rotate, uncoupling said first coupling surface from said second coupling surface, whereupon said spring causes said latch member to rotate, providing an impact momentum for actuating said means coupled to said contact arm, thereby tripping said contact arm, opening said contacts.

2. Apparatus as recited in claim 1 wherein said armature latch axis and said latch member axis are non-coincident.

3. Apparatus as recited in claim 1 wherein said first coupling surface and said second coupling surface have relatively low coefficients of friction.

4. In a circuit breaker including
a housing;
a fixed contact held by said housing;
a contact movable within said housing, adapted to engage with and disengage from said fixed contact;
a contact arm coupled to said movable contact;
means coupled to said contact arm for causing said contact arm to trip when said means is actuated; and
apparatus for actuating said means, the improvement wherein said apparatus comprises
an electrical circuit including
a load terminal,
a bimetal strip having one end fixed to said load terminal and having an opposite end free to bend when thermally excited, and
a flexible conductive braid having an end fixed to said opposite end and having a second end coupled to said contact arm,
said load terminal being fixed with respect to said housing;
an armature latch of ferrous material partially rotatable about a point with respect to said housing;
having a first end adapted to engage with said opposite end of said bimetal strip,
having a second end provided with a first retaining means, and
having an intermediate coupling portion;
a latch member partially rotatable about a point with respect to said housing,
having a portion thereof provided with a second retaining means;
having a coupler adapted to couple with respect to said coupling portion, and
having an arm for recoupling said coupler subsequent to said coupler becoming uncoupled from said coupling portion; and
a spring coupled between said first retaining means and said second retaining means; whereby a current overload of a small magnitude through said electrical circuit causes said bimetal strip to be thermally excited and bend, moving and partially rotating said first end of said armature latch, thereby uncoupling said coupling portion from said coupler, whereupon said spring causes said latch member to be rotated, providing an impact momentum to actuate said means coupled to said contact arm, thereby tripping said contact arm, opening said contacts, and a current overload of a high magnitude through said electrical circuit sets up a sufficiently strong magnetic field to thereby rapidly attract and partially rotate said ferrous armature latch, thereby uncoupling said coupling portion from said coupler, whereupon said spring causes said latch member to be rotated, providing an impetus to actuate said means coupled to said contact arm, thereby tripping said contact arm, opening said contacts.

5. Apparatus as recited in claim 4 wherein said armature latch pivot axis and said latch member pivot axis are separate from each other.

6. Apparatus as recited in claim 4 wherein said coupling portions have relatively low coefficients of friction.

7. Apparatus as recited in claim 4 further comprising a ferrous member coupled to said bimetal strip.

8. A trip unit for a circuit breaker comprising a carrier member having two separate, spaced-apart axes;

a first member adapted to pivot about one of said axes, said first member having a latching portion distant from said one axis;

a second member adapted to pivot about the other of said axes, said second member having a latching portion distant from said other axis; and a spring connecting said first member to said second member so that said first member and said second member are latched together at said latching portions thereby forming a triangular geometry with said members, whereby rotation of said first member about said one axis in an unlatching direction causes said first member to unlatch from said second member, and rotation of said second member about said other axis in a latching direction causes said second member to latch with said first member.

* * * * *